US006813806B2

(12) United States Patent
Martinez

(10) Patent No.: US 6,813,806 B2
(45) Date of Patent: Nov. 9, 2004

(54) HOSE ATTACHMENT DEVICE

(75) Inventor: Jesus Fernandez-Grandizo Martinez, Mexico City (MX)

(73) Assignee: Koblenz Electrica, S.A. De C.V., Cauautitlan Izcalli (MX)

( * ) Notice: Subject to any disclaimer, the term of this patent is extended or adjusted under 35 U.S.C. 154(b) by 333 days.

(21) Appl. No.: 10/072,770

(22) Filed: Feb. 7, 2002

(65) Prior Publication Data

US 2003/0145415 A1 Aug. 7, 2003

(51) Int. Cl.[7] ..... A47L 9/24

(52) U.S. Cl. ..... 15/323; 15/339; 15/327.2; 285/7; 248/75; 248/79; 248/74.1

(58) Field of Search ..... 15/323, 339, 410, 15/327.2; 138/120, 155; 285/7; 248/75, 79, 65, 74.1, 231.2

(56) References Cited

U.S. PATENT DOCUMENTS

| | | | | | |
|---|---|---|---|---|---|
| 1,627,734 | A | * | 5/1927 | Gavaza | 248/79 |
| 3,747,166 | A | | 7/1973 | Eross | |
| 4,563,789 | A | | 1/1986 | Berfield | |
| 4,761,850 | A | | 8/1988 | Romeo et al. | |
| 4,835,814 | A | * | 6/1989 | Bonnet | 15/339 |
| 5,137,156 | A | | 8/1992 | Riczinger et al. | |
| 5,247,719 | A | | 9/1993 | Wareham et al. | |
| 5,331,714 | A | | 7/1994 | Essex et al. | |
| 5,647,091 | A | | 7/1997 | DeBlois et al. | |
| 5,742,976 | A | | 4/1998 | Bensussen et al. | |
| 6,101,669 | A | | 8/2000 | Martin et al. | |
| D435,322 | S | | 12/2000 | DeBlasis et al. | |
| 6,175,988 | B1 | | 1/2001 | White et al. | |
| 6,260,233 | B1 | | 7/2001 | Wareham et al. | |
| 6,615,442 | B2 | * | 9/2003 | Yang | 15/323 |
| 2001/0029642 | A1 | * | 10/2001 | Firdaus et al. | 15/410 |

* cited by examiner

*Primary Examiner*—Theresa T. Snider
(74) *Attorney, Agent, or Firm*—Wildman, Harrold, Allen & Dixon; Thomas J. Ring

(57) ABSTRACT

A device for attaching a hose to a housing. The device comprises first and second arms that are attached to the hose. The first arm extends outward from the hose toward the second arm and the second arm extends outward from the hose toward the first arm.

21 Claims, 3 Drawing Sheets

HOSE ATTACHMENT DEVICE

BACKGROUND

Vacuum cleaners, air pumps, water pumps, and blowers are but a few examples of devices that utilize a hose to perform a core function. When in use, these devices generally have one end of a hose inserted within a housing and a free end which a user can manipulate to direct a stream of air, water, suction, etc. to a desired location. Some of these hoses are detachable so that they can be removed from the housing when the device is not in use. Others are not detachable so one end is always connected to the housing and one end is always free.

When not in use, it is desirable to be able to store these devices in a space effective fashion. The awkward unwieldy nature of hoses, however, does not always make this possible. Too often, one or both ends of a hose ends up on the floor, or in a corner, where it is susceptible to damage from dirt, dust, or accident. Therefore, it is desirable to provide devices, such as vacuum cleaners, with some mechanism for attaching one or both ends of a hose to the housing of the device when the hose is not in use.

SUMMARY OF THE INVENTION

Pursuant to the present invention, advantages are provided through the provision of a hose mounting device.

In one example, the invention comprises a device for attaching a hose to a housing of a device, such as a vacuum cleaner pump, blower or the like, that utilizes the hose. The device includes first and second arms that are attached to the hose. The first arm extends outward from the hose toward the second arm. The second arm extends outward from the hose toward the first arm.

DETAILED DESCRIPTION

In accordance with the principles of the present invention, a device for attaching a hose to housing of an apparatus is now provided.

A detailed discussion of one exemplary embodiment of the invention is presented herein, for illustrative purposes.

Figure 1:
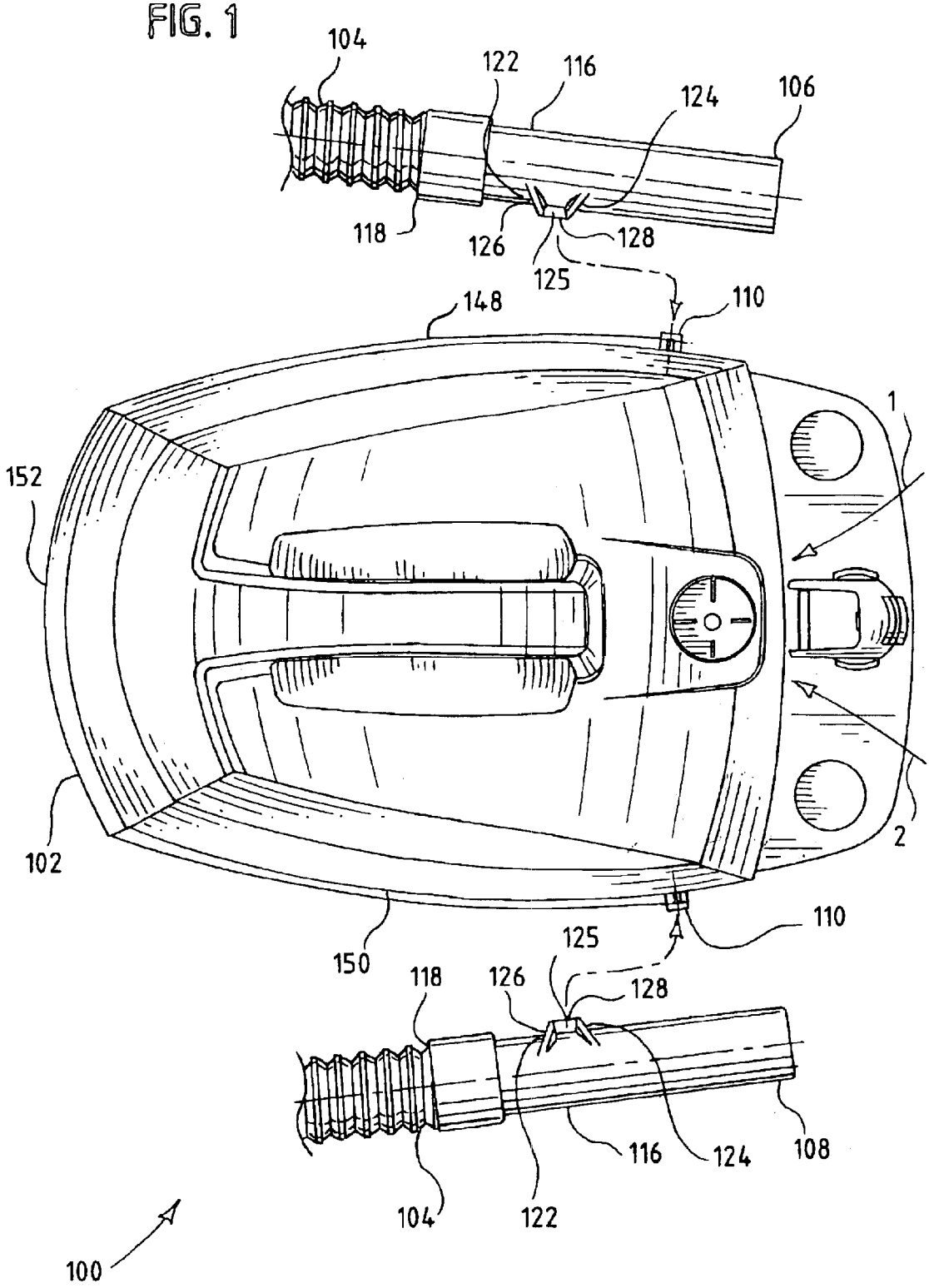
FIG. 1 is a top plan view of an apparatus housing and partial cut away views of a hose with hose ends spaced apart from the apparatus housing.

Turning to FIG. 1, an apparatus that utilizes a hose is shown. As was stated above, the apparatus could comprise a vacuum cleaner, a blower, an air pump, a water pump, or any other device that utilizes a hose to perform a function. In the example shown in FIG. 1, a vacuum cleaner 100 is shown. Vacuum cleaner 100 comprises housing 102 and hose 104. For the sake of brevity only a first end 106 and a second end 108 of hose 104 are shown.

Housing 102 includes a hose receptacle (not shown) that is located generally in the area defined by arrows 1 and 2. When in use, first end 106 of hose 104 is inserted into the hose receptacle while second end 108 is kept free. The suction action of the vacuum then draws air (and/or debris) into second end 108, through the length of hose (not shown), out first end 106, and into housing 102, where a vacuum cleaner bag, receptacle, or other means for trapping debris is located.

Housing 102 further includes one or more instances of engagement member 110 which is connected to housing 102. Engagement member 110 is utilized to connect hose 104 to housing 102 as will be discussed herein.

Hose 104 can be flexible and/or non-flexible. Hose 104 can be made of any variety of materials, such as plastic, rubber, aluminum, etc. In addition, one part of hose 104 could be made of one material, while another part of hose 104 could be made of another material.

Hose 104 in one example has an adapter 116 attached at first end 106 and/or second end 108. Adapter 116 in one example has an opening 118 on at least one end through which hose 104 is securely received. Each adapter 116 includes a first arm 122 and a second arm 124. In one example, first arm 122 and second arm 124 are attached integrally to adapter 116.

Through adapter 116, first arm 122 and second arm 124 are attached to hose 104. First arm 122 extends outward from adapter 116 toward second arm 124, and second arm 124 extends outward from adapter 116 toward first arm 122. The combination of first arm 122 and second arm 124 form a recess 125 that extends outward from each adapter 116 (and inherently from hose 104). Recess 125 can be employed to attach hose 104 to housing 102, as will be discussed herein.

Figure 2:
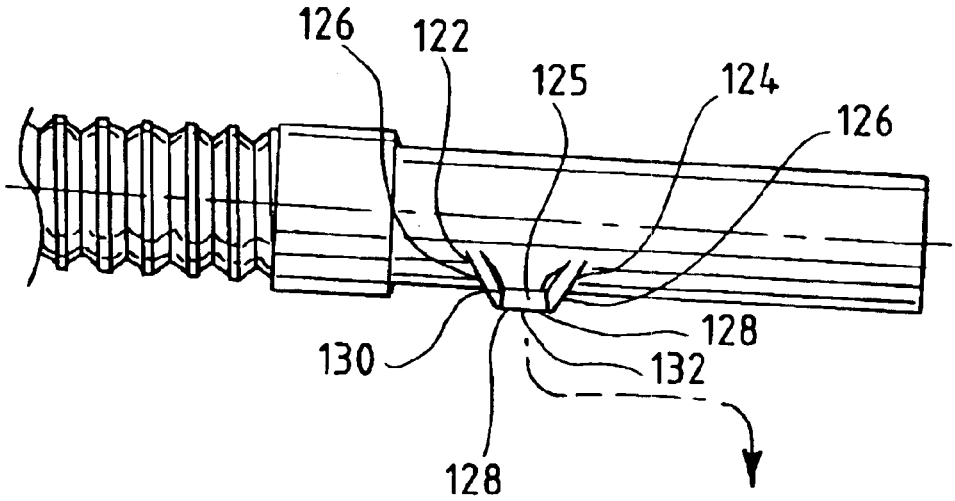
FIG. 2 is an enlarged view of one hose end of FIG. 1.

Referring to FIG. 2, first arm 122 and second arm 124 each comprise a base portion 126 and an end portion 128. Base portions 126 of arms 122, 124 are attached to adapter 116 in a spaced apart relationship.

The distance between base portions 126 of arms 122, 124 define a crosswise opening 130, that forms a portion of recess 125. Crosswise opening 130 is utilized to receive a portion of engagement member 110 as will be discussed herein.

As was stated earlier, first arm 122 and second arm 124 also each include an end portion 128. End portions 128 in one example are attached integrally to base portions 126. End portions 128 also have a spaced apart relationship. The distance between end portions 128 defines a longitudinal opening 132, which forms a second portion of recess 125. Longitudinal opening 132 is utilized to receive a portion of engagement member 110 as will be discussed herein.

As FIG. 2 shows, longitudinal opening 132 is transverse and in communication with crosswise opening 130. Accordingly, crosswise opening 130 and longitudinal opening 132 combine to form recess 125, which in one example has a "T" shaped cross section.

Figure 3:
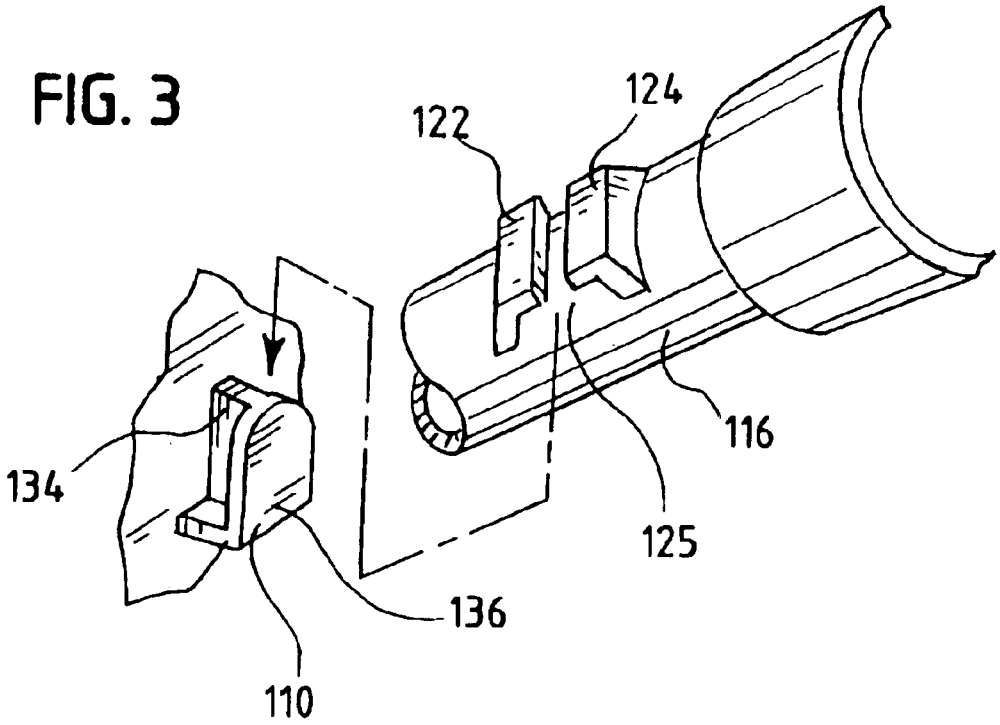
FIG. 3 is an enlarged partial view of one hose end of FIG. 1 showing an exploded view of arms engaged with an engagement member of the housing.

Turning to FIG. 3, an exploded view of arms 122, 124 when engaged with engagement member 110, is shown. Engagement member 110 could be located on any portion of housing 102. Moreover, more than one engagement member can be attached to housing 102. In FIG. 1, two engagement members are attached to opposing sides of housing 102. Engagement member 110 is adaptable to be received within recess 125 that extends outward from adaptor 116. Engagement member 110 in one example comprises a longitudinal portion 134 and a crosswise portion 136. Longitudinal portion 134 is transverse and in communication with crosswise portion 136. Accordingly, longitudinal portion 134 and crosswise portion 136 have a "T" shaped cross section.

Figure 4:
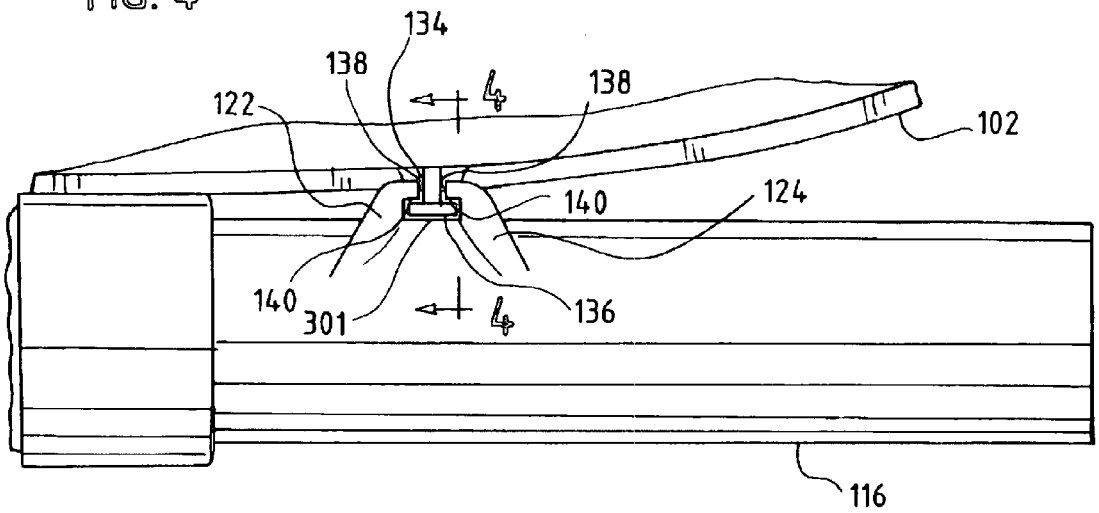
FIG. 4 is a magnified partial view of one side of the apparatus housing and one hose end of FIG. 1 showing the engagement member engaged with arms on the hose end

To attach hose 104 to housing 102, a user simply places or hooks recess 125 over engagement member 110. When recess 125 and engagement member 110 are engaged, as shown in FIGS. 3 and 4, longitudinal portion 134 of engagement member 110 is received within longitudinal opening 132, and crosswise portion 136 is received within crosswise opening 130. Both crosswise opening 130 and longitudinal opening 132 are obscured in FIGS. 3 and 4 but are seen clearly in FIG. 2. Therefore, opposing sides 138 of end portions 128 of first arm 122 and second arm 124 are in contact with longitudinal portion 134, and opposing sides 140 of end portions 128 are in contact with crosswise portion 136. The contact between opposing sides 140 of end portions 128 with crosswise portion 136 holds adapter 116 (and inherently hose 104) to housing 102.

Figure 5:
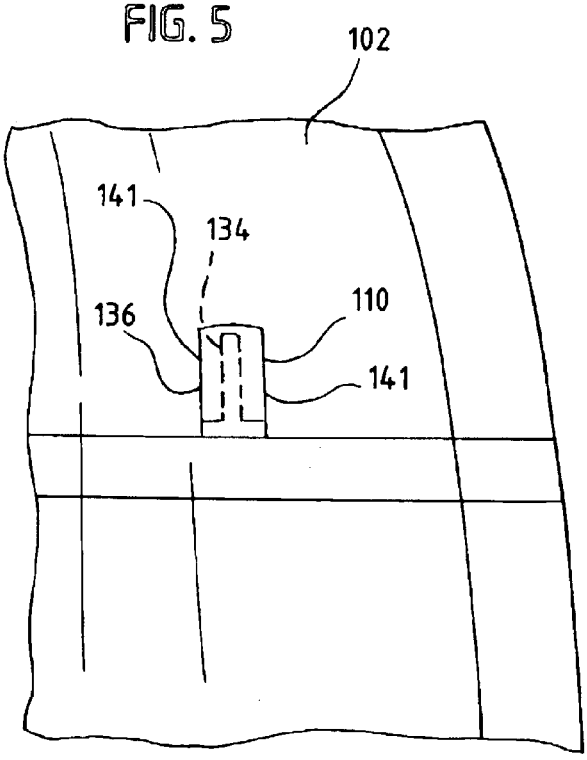
FIG. 5 is a side elevational view of the apparatus housing of FIG. 1 showing the engagement member.

Referring to FIG. 5, a frontal view of engagement member 110 is shown. Longitudinal portion 134 is shown as a dotted line and extends out of the page from housing 102. Longitudinal portion 134 is connected to crosswise portion 136. Longitudinal portion 134 is transverse to and in communication with crosswise portion 136. To connect hose 104 to housing 102, a user places recess 125 (FIG. 2) over crosswise portion 136, and opposing sides 140 of end portions 128 (FIG. 4) of arms 122, 124 then contact opposing sides 141 of crosswise portion to hold adapter 116 to housing 102.

Figure 6:
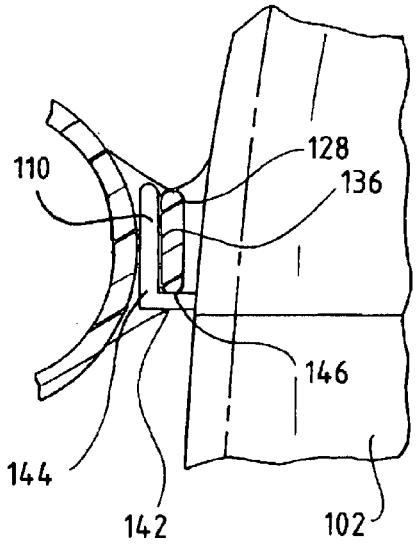
FIG. 6 is an enlarged partial view of the apparatus housing and hose end of FIG. 1 showing the engagement of the arms and engagement member.

Turning to FIG. 6, it is shown that engagement member 110 includes a plate 142 that is connected to housing 102 and to the bottom sides 144 of longitudinal portion 134 (not shown) and crosswise portion 136. Longitudinal portion 134 and crosswise portion 136 extend upward from plate 142. Bottom sides 146 of end portions 128 of first arm 122 of second arm 124 contact plate 142 when recess 125 is placed over crosswise portion 136 and engaged with engagement member 110. This contact between end portions 128 and plate 142 prevents the adapter 116, and by extension, hose 104, from sliding downward off engagement member 301 when engaged with recess 125.

Turning back to FIG. 1, it is shown that hose 104 can be attached to an apparatus, such as vacuum cleaner 100, by attaching an adapter 116 at first end 106 and second end 108 of hose 104. Engagement members 110, are then attached opposing sides 148, 150 of housing 102. A user then simply utilizes recesses 125 and engagement members 110, to attach hose 104 to housing 102 on each side 148, 150, by placing each recess 125 over each engagement member 110, The "T" shaped cross section of engagement members 110, easily fits within the "T" shaped space formed by recess 125. Plate 142 prevents adapter 116 from sliding off of housing 102. Hose 104 is then attached on each side 148, 150. The intermediate part of hose (not shown) can then be wrapped around housing 102.

It should be noted that in the description provided above, hose 104 is attached to housing 102 through the use of adapter 116. However, it is envisioned that instead of using adapter 116, first arm 122 and second arm 124 could be integrally attached to hose 104. This could be accomplished in one example by fastening first arm 122 and second arm 124 directly to hose 104 through any reasonable method (e.g., gluing, molding, etc.).

It should be further noted that engagement member 110 and recess 125 are shown having a "T" shaped cross section; however, it is envisioned that they could have alternate shapes, so long as engagement members 110 can fit securely within recess 125 to hold hose 104 securely to housing 102.

It should also be noted the example shown in FIG. 1 depicts a configuration wherein hose 104 is attached to housing 102 in two places. The intermediate part of hose 104 could also be secured to housing 102 by positioning a third engagement member 110 on an end 152 of housing 102. A corresponding set of arms 122, 124 could then be attached to hose 104, either through an adapter 116 or by attaching an additional set of arms 122, 124 to hose 104. In the former case, the adapter 116 would have to securely fit over the intermediate portion of hose 104 without crimping it to an extend that hose 104 would not function.

Another way in which the intermediate portion of hose 104 can be secured to housing 102 is by making the circumference of housing 102 such that it is the same length or slightly longer than hose 104. When hose 104 is connected to engagement members 110 in the case of a hose made of flexible material, hose 104 would flex slightly and engagement members 110 would provide a bias against the flexibility of hose 104. Hose 104 would then be snug around housing 102.

It is further envisioned that hose 104 could be connected to housing 102 in as many places as necessary. For instance, longer hoses could be accommodated by placing more than three engagement members along the periphery of housing 102. More recesses 125 could be formed by positioning corresponding pairs of arms 122, 124 along hose 104, either through adapters 116 or by attaching arms 122, 124 to hose 104 integrally. Hose 104 could then be wrapped around housing 102 as many times as necessary to effectively secure hose 104.

In another example, housing 102 could only have one engagement member 110 attached. One end of hose 104 could be permanently attached to housing 102 through the hose receptacle while the other end of hose 102 is attached to housing 102 as described above.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A device for attaching a hose to a housing, the device comprising:

first and second arms that are attached to the hose, wherein the first arm extends outward from the hose toward the second arm and the second arm extends outward from the hose toward the first arm.

2. The device of claim 1, further comprising:

an adapter having an opening on at least one end, wherein the hose is securely received within the opening, and the first and second arms are attached to the adapter.

3. The device of claim 2, wherein the first and second arms are attached integrally to the adapter.

4. The device of claim 1, wherein the first arm and the second arm each comprise:

a base portion; and an end portion.

5. The device of claim 4, wherein respective base portions of the arms are attached to the hose in a spaced apart relationship.

6. The device of claim 5, wherein respective end portions of the arms are attached to the base portions and have a spaced apart relationship.

7. The device of claim 6, wherein the end portions define a longitudinal opening.

8. The device of claim 7, wherein the base portions define a crosswise opening.

9. The device of claim 8, wherein the longitudinal opening is transverse and in communication with the crosswise opening.

10. The device of claim 9, wherein the longitudinal opening and the crosswise opening form a "T" shaped recess.

11. The device of claim 9, further comprising:

an engagement member that is connectable to a housing, the engagement member adaptable to be received within the longitudinal opening and the crosswise opening.

12. The device of claim 11, wherein the engagement member comprises:

a longitudinal portion and a crosswise portion.

13. The device of claim 12, wherein the longitudinal portion is transverse to and in communication with the crosswise portion.

14. The device of claim 13, wherein the longitudinal portion and the crosswise portion have a "T" shape.

15. The device of claim 13, wherein the longitudinal portion can be received in the longitudinal opening and the crosswise portion can be received in the crosswise opening.

16. The device of claim 15, wherein the end portions are in contact with the longitudinal portion when the longitudinal portion is received in the longitudinal opening.

17. The device of claim 15, wherein the base portions and the end portions are in contact with the crosswise portion when the crosswise portion is received within the crosswise opening.

18. The device of claim 15, wherein the engagement member further comprises:

a plate that is connected to bottom sides of the longitudinal portion and the crosswise portion respectively.

19. The device of claim 18, wherein the plate is in contact with bottom sides of the end portions when the engagement member is received within the longitudinal opening and the crosswise opening.

20. A vacuum cleaner, comprising:

a housing:

a hose having a first end and a second end; and a device for attaching the first end of the hose to the housing, including:

first and second arms attached to the hose, wherein the first arm extends outward from the hose toward the second arm and the second arm extends outward from the hose toward the first arm:

the first and second arms each having a base portion and an end portion, wherein the base portions of the arms are attached to the hose in a spaced apart relationship defining a crosswise opening and the end portions of the arms are attached to the base portions and have a spaced apart relationship defining a longitudinal opening, which is transverse and in communication with the crosswise opening;

an engagement member, connectable to the housing and adaptable to be received within the longitudinal opening and crosswise openings, having a crosswise portion, a longitudinal portion that is transverse to and in communication with the crosswise portion, and a plate that is connected to bottom sides of the longitudinal portion and the crosswise portion respectively;

wherein the longitudinal portion can be received in the longitudinal opening, the crosswise portion can be received in the crosswise opening, and the plate is in contact with bottom sides of the end portions when the engagement member is received within the longitudinal opening and the crosswise opening.

21. The vacuum cleaner of claim 20, further comprising:

a device for attaching the second end of the hose to the housing, including;

third and fourth arms attached to the hose, wherein the third arm extends outward from the hose toward the fourth arm and the fourth arm extends outward from the hose toward the third arm;

the third and fourth arms each having a base portion and an end portion, wherein the base portions of the arms are attached to the hose in a spaced apart relationship defining a crosswise opening and the end portions of the arms are attached to the base portions and have a spaced apart relationship defining a longitudinal opening, which is transverse and in communication with the crosswise opening;

a second engagement member, connectable to the housing and adaptable to be received within the longitudinal opening and crosswise opening defined by the third and fourth arms, having a crosswise portion, a longitudinal portion that is transverse to and in communication with the crosswise portion, and a plate that is connected to bottom sides of the longitudinal portion and the crosswise portion respectively;

wherein the longitudinal portion can be received in the longitudinal opening, the crosswise portion can be received in the crosswise opening, and the plate is in contact with bottom sides of the end portions when the second engagement member is received within the longitudinal opening and the crosswise opening.

* * * * *